United States Patent [19]

Yamashita et al.

[11] Patent Number: 5,048,662

[45] Date of Patent: Sep. 17, 1991

[54] COIN DISCRIMINATOR

[75] Inventors: Riichiro Yamashita; Koichi Kanehara, both of Hyogo, Japan

[73] Assignee: Mitsubishi Jukogyo Kabushiki Kaisha, Tokyo, Japan

[21] Appl. No.: 495,387

[22] Filed: Mar. 16, 1990

[30] Foreign Application Priority Data

Apr. 19, 1989 [JP] Japan ..... 1-44999[U]

[51] Int. Cl.[5] ..... G07D 5/08

[52] U.S. Cl. ..... 194/317; 73/163

[58] Field of Search ..... 194/317, 318, 319; 73/163; 324/225, 236

[56] References Cited

U.S. PATENT DOCUMENTS

| | | | |
|---|---|---|---|
| 3,749,220 | 7/1973 | Tabiichi et al. | 194/319 |
| 4,275,806 | 6/1981 | Tanaka et al. | 194/317 |
| 4,431,014 | 2/1984 | Yokomori | 194/317 X |
| 4,471,864 | 9/1984 | Marshall | 194/317 |
| 4,690,263 | 9/1987 | Yokomori | 194/317 |
| 4,946,019 | 8/1990 | Yamashita | 194/318 |

FOREIGN PATENT DOCUMENTS

| | | | |
|---|---|---|---|
| 3034156 | 3/1982 | Fed. Rep. of Germany | 73/163 |
| 2128793 | 5/1984 | United Kingdom | 194/317 |

*Primary Examiner*—F. J. Bartuska

*Attorney, Agent, or Firm*—Toren, McGeady & Associates

[57] ABSTRACT

A coin discriminator discriminates a genuine coin from a counterfeit on the basis of a real component and an imaginary component of an impedance of the coin produced from a high frequency alternating current bridge circuit and decides an amount of the coin when the coin is genuine. An automatic balancing circuit having a sufficiently long time constant is employed to detect variations in the real component and the imaginary component of the impedance due to insertion of the coin. Whether the coin is genuine or counterfeit is discriminated on the basis of peak values of both variations and when the coin is genuine, an amount of the coin is decided.

4 Claims, 3 Drawing Sheets

COIN DISCRIMINATOR

FIELD OF THE INVENTION AND RELATED ART STATEMENT

The present invention relates to a coin discriminator which is applied to a charge collecting machine, various automatic vending machines, an exchanger and the like.

The coin discriminator is used in an automatic toll collector installed in toll roads, parking places and the like, various automatic vending machines, an exchanger and the like.

As a coin sensor, heretofore, there are two types of coin sensors in which the first utilizes a method of detecting mainly a shape such as a diameter, a thickness and the like and the second utilizes a method of detecting electrical characteristics (permeability, resistivity and the like) of material in addition to the shape.

FIG. 4 is a block diagram showing a circuit configuration of a conventional coin discriminator disclosed in Japanese Application No. 63-52967.

The principle of the above conventional coin discriminator utilizes detection of an impedance variation produced by an eddy current loss generated in a coin when the coin approaches a coil excited by a high frequency signal in order to distinguish a kind of the coin and a counterfeit coin. The impedance variation is different depending on the shape (diameter, thickness and the like) of the coin and material (permeability, resistivity and the like) of the coin.

In FIG. 4, a detection coil $L_1$, a reference coil $L_2$ and balance resistors Rr and Rc constitute a bridge circuit. Co is a condenser. An oscillator 1 supplies a high frequency voltage to the bridge circuit. The bridge circuit is adjusted so that an output voltage thereof (at the junction between the coils $L_1$ and $L_2$) is zero volt by adjusting the balance resistors Rr and Rc when no coin exist in the magnetic field of the detection coil $L_1$. In this state, when a coin is inserted into the detection coil $L_1$, an impedance variation occurs in accordance with a shape and material of the coil and the output voltage of the bridge circuit changes in proportion to the impedance variation. A tuned amplifier 2 selects and amplifies a frequency component of the output voltage supplied from the bridge circuit and removes other noise component to amplify the output of the bridge circuit. A low pass filter 3 cuts a high frequency component supplied to the bridge circuit and detects a variation of a low frequency voltage generated due to the coin opposite to the detection coil 2. Since the magnitude of the voltage is different depending on a kind of coin, the kind of coin is decided on the basis of a decision level set in a threshold circuit 4.

On the other hand, a phase shifter is supplied with a voltage of an oscillator 1 constituting a power source for the bridge circuit as an input reference voltage and produces an in-phase voltage and a voltage delayed by $\pi/2$ which are supplied to phase detectors 6 and 7, respectively. The phase detectors 6 and 7 are also supplied with an output voltage Ez produced from the tuned amplifier 2 and decomposes it into an in-phase component (a real component of an impedance) and a $\pi/2$ delayed component (an imaginary component of an impedance). FIG. 5 shows the output voltage Ez decomposed into the in-phase component and the $\pi/2$ delayed component. Assuming that the output voltage Ez is produced from the tuned amplifier 2 when a coin is opposed to the detection coil $L_1$, the in-phase detector 6 produces an in-phase component Ex of the voltage Ez and the $\pi/2$ delayed phase detector 7 produces a $\pi/2$ delayed component Ey thereof.

The components Ex and Ey correspond to the real component and the imaginary component of the impedance of the detection coil, respectively.

Since the components Ex and Ey contain a high frequency component, the components Ex and Ey are supplied to low pass filters 8 and 9, respectively, in the same manner as the output voltage Ez of the tuned amplifier 2 to detect low frequency components thereof (variation when the coin passes through the detection coil $L_1$) and are decomposed into a real component X and an imaginary component Y for measurement, respectively.

The real and imaginary components are supplied to a phase difference calculator 10 which calculates a triangular function $\tan^{-1}(X/Y)$ from a ratio therebetween to obtain a phase $\theta$. The calculated phase $\theta$ is varied in accordance with variation of a shape and material of the coin. The phase $\theta$ is classified by a threshold circuit 11 and is supplied to a logic circuit 12 which calculates a logical product of the output of the threshold circuit 11 and the impedance level which is the output produced from the threshold circuit 4 to discriminate a kind of the coin.

OBJECT AND SUMMARY OF THE INVENTION

In the conventional coin discriminator, although variation in the initial impedance of the detection coil $L_1$ and the reference coil $L_2$ is adjusted by the balance resistors Rr and Rc of the bridge circuit so that the output voltage of the bridge circuit is adjusted to be zero, drift voltages $\Delta Z$, $\Delta X$ and $\Delta Y$ occur in the output Z of the low pass filter 3, the in-phase detection output X of the low pass filter 8 and the $\pi/2$ delayed detection output Y of the low pass filter 9, respectively, when values of the impedances of the detection coil $L_1$, the reference coil $L_2$ and the balance resistors Rr and Rc are drifted and the balance of the bridge circuit collapses, and the drift voltages affect the outputs Z, X and Y by the coin as error to cause erroneous decision.

Further, the variation voltages Z, X and Y by the coin are proportional to the output of the oscillator 1 which is the voltage supplied to the bridge circuit, and accordingly there is a problem that erroneous decision is caused in the same manner when the output of the oscillator 1 is varied due to the temperature.

It is an object of the present invention to provide a coin discriminator capable of solving the above problems in the prior art.

In order to achieve the above object, the coin discriminator according to the present invention including a bridge circuit having a detection coil, a reference coil and a balancing circuit, an oscillator for supplying a high frequency voltage to the bridge circuit, a tuned amplifier for amplifying an output voltage of the bridge circuit, a phase shifter for producing an in-phase voltage and a voltage delayed by $\pi/2$ in respect to an oscillation voltage of the oscillator and a phase detector for detecting an in-phase component and a $\pi/2$ delayed component from an output voltage of the tuned amplifier on the basis of the in-phase voltage and the $\pi/2$ delayed voltage produced by the phase shifter to thereby discriminate a coin on the basis of a voltage variation in the in-phase component and the $\pi/2$ delayed component, comprises first and second automatic balancing circuits each including a differential amplifier and an integrator, the differential amplifiers for the first and second automatic balancing circuits having one input terminals to which output voltages of the in-phase component and the $\pi/2$ delayed component are supplied, respectively, and the other input terminals to which an output voltage of the integrator is supplied, an output signal of the differential amplifier being supplied to the integrator, a circuit for automatic compensating slow variation when an output of the detection coil is drifted due to a temperature, and a rectifier for converting the voltage of the oscillator supplied to the bridge circuit to a dc voltage, whereby variation voltages in the in-phase voltage component and the $\pi/2$ delayed voltage component produced from the bridge circuit through the automatic balancing circuit and a rectified output voltage supplied to the bridge circuit are calculated to discriminate a kind of the coin and a counterfeit coin.

In a preferred embodiment, there is provided a peak hold circuit for holding peak values of the in-phase component and $\pi/2$ delayed component voltages of the bridge circuit obtained through the automatic balancing circuit and a peak detection circuit for detecting passage of peak points of both output voltages, whereby variations by the coin of the in-phase component and $\pi/2$ delayed component voltage produced by the bridge circuit are obtained on the basis of the in-phase component and $\pi/2$ delayed component peak values and the output voltage obtained by rectifying the voltage supplied to the bridge circuit to thereby discriminate whether the coin in genuine or counterfeit and decide an amount of coin.

In a further preferred embodiment, there is provided a time division switching circuit supplied with the peak values of the outputs of the two automatic balancing circuits for the in-phase component and the $\pi/2$ delayed component and the output voltage of the rectifier, an A/D converter for converting an output voltage of the time division switching circuit to a digital voltage successively, and a microcomputer triggered by an OR signal of the peak detection circuits to take in the digital voltage from the A/D converter, whereby the microcomputer discriminates whether the coin is genuine or counterfeit and decides an amount of the coin.

Since the present invention is configured as above, even if the output of the bridge circuit is drifted due to temperature variation and a voltage error occurs, the voltage error is compensated automatically to be zero and accordingly any error is not contained in the variation voltage due to the coin. Further, even if the voltage supplied to the bridge circuit is varied, the voltage variation due to the coin can be corrected on the basis of the variation ratio and accordingly erroneous decision due to variation of the output by the coin due to variation of the voltage supplied to the bridge circuit caused by the drift of the output voltage of the bridge circuit can be prevented.

DETAILED DESCRIPTION OF A PREFERRED EMBODIMENT

Figure 1:
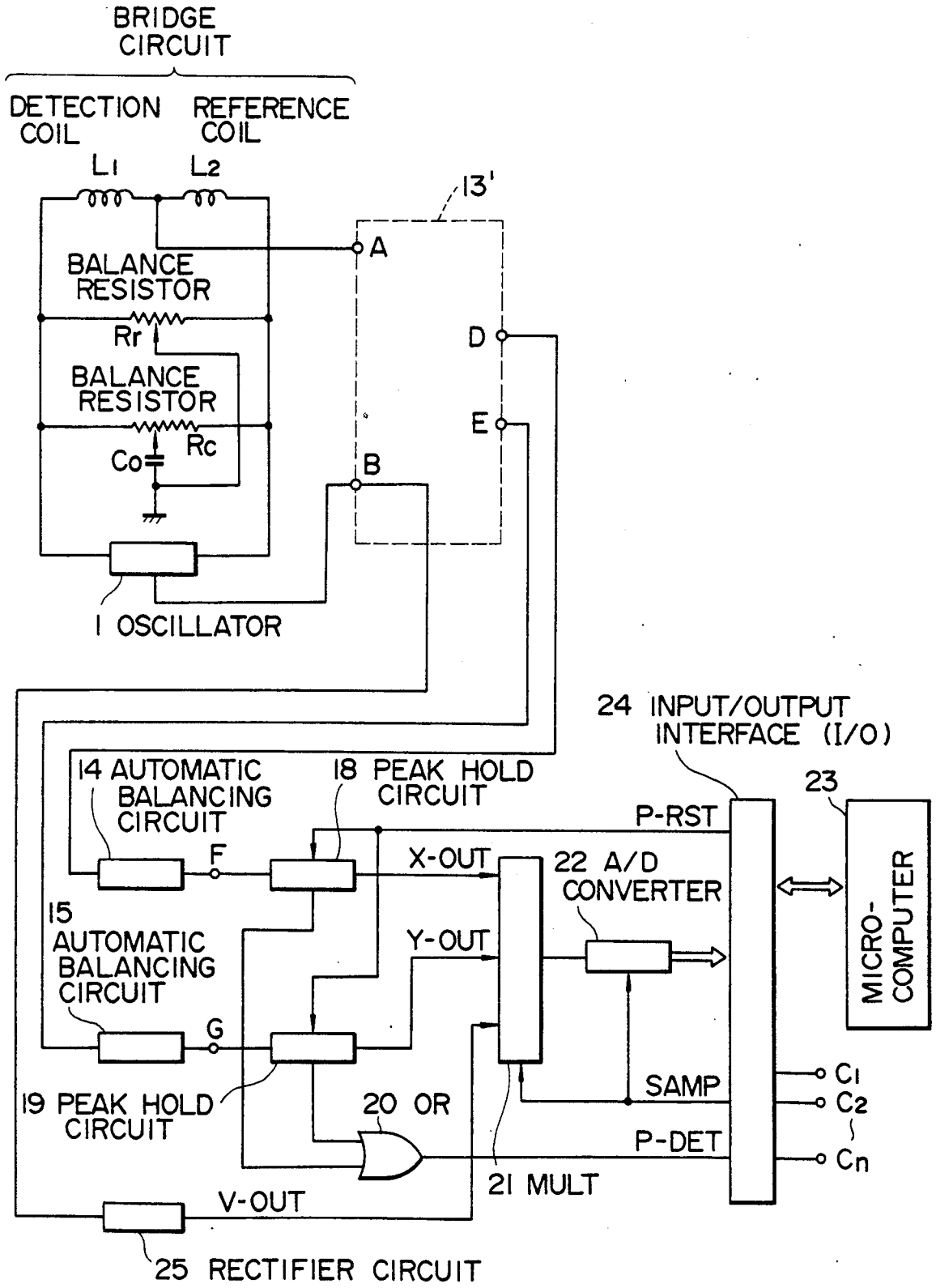
FIG. 1 is a circuit block diagram showing an embodiment of the present invention.
Figure 4:
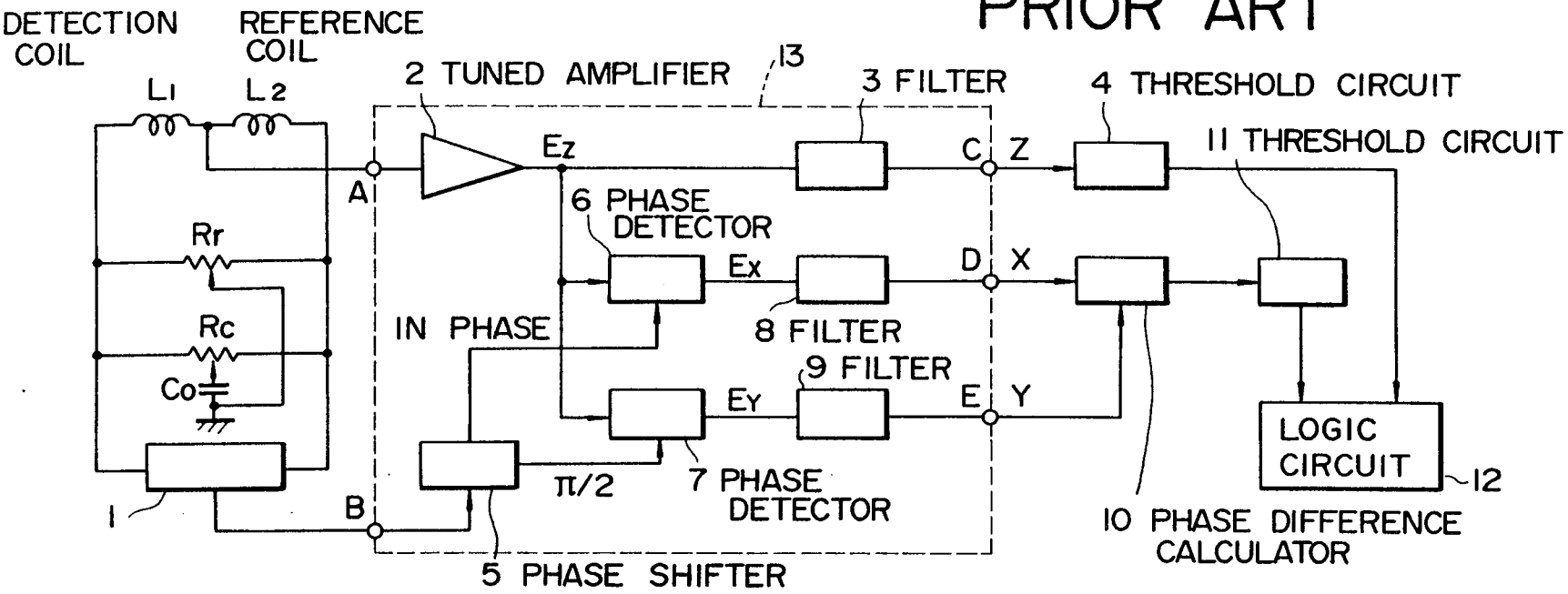
FIG. 4 PRIOR ART
FIG. 4 is a circuit block diagram of a conventional coin discriminator.
Figure 5:
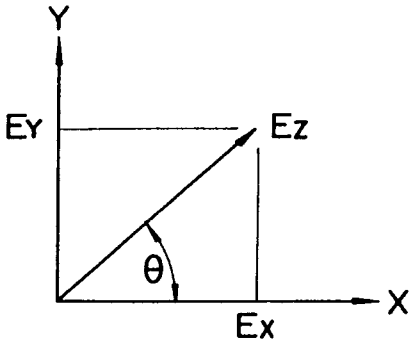
FIG. 5 PRIOR ART
FIG. 5 is a vector decomposition diagram.

FIG. 1 shows an embodiment of the present invention. In FIG. 1, the bridge circuit constituted of the detection coil $L_1$, the reference coil $L_2$ and the balance resistors Rr and Rc and the oscillator 1 which produces the voltage supplied to the bridge circuit 1 are the same as those of FIG. 4. The circuit enclosed with broken line 13' is the same circuit as that enclosed with broken line 13 in FIG. 4 and accordingly configuration and operation thereof are omitted. However, the low pass filter 3 in the circuit is removed from the circuit block 13' of FIG. 1 for simplification. The reason is that since the impedance variation Ez shown in FIG. 5 has a relationship $Ez=\sqrt{Ex^2+Ey^2}$ for the real (resistor) component Ex and the imaginary (reactance) component Ey, the components Ex and Ey are measured to obtain polar coordinates and the component Ez can be obtained, and accordingly the low pass filter 3 can be omitted.

Description is now made to signal processing subsequent to the in-phase component X (terminal D) and the $\pi/2$ delayed component Y (terminal E) of the output of the bridge circuit in the prior art.

Figure 2:
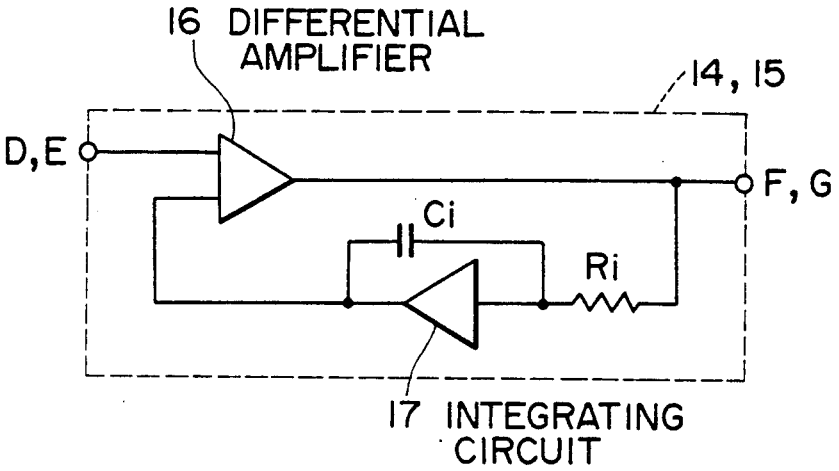
FIG. 2 is a automatic balancing circuit diagram showing in detail a part of FIG. 1.

In FIG. 1, reference numerals 14 and 15 denote automatic balancing circuits which compensate for drift of the output of the bridge circuit. Actually, each of the automatic balancing circuits 14 and 15 comprises a differential amplifier 16 and an integrating circuit 17 as shown in FIG. 2. In FIG. 2, a resistor Ri and the condenser Ci determine a time constant. The integration time constant is determined by $T=Ri \cdot Ci$ and the time constant is long to the extent that the time constant follows slow variation drifting by the temperature or the like but hardly follows instantaneous variation produced when the coin passes through the detection coil 1. Accordingly, as shown in FIG. 2, when the feedback is formed through the differential amplifier 16, drift in the bridge circuit is canceled through the integrating circuit 17 so that the output F (or G) is automatically adjusted to zero and only the instantaneous variation due to passage of the coin is detected. Numerals 18 and 19 denote peak hold circuits constituted of a hybrid circuit of a peak holder and a peak detector and which holds a peak value of the instantaneous variation produced when the coin passes through the detection coil $L_1$ and detects a passing time of the peak point. (A pulse signal is produced after passage.) Numeral 20 denotes an OR circuit to which peak point passing signals from the peak hold circuits 18 and 19 are supplied. An output signal P-DET of the OR circuit 20 is a trigger signal supplied to an operation circuit connected to the OR circuit and the operation circuit produces a sampling command signal (SAMP) for the output voltages X-OUT and Y-OUT of the peak hold circuits 18 and 19 in response to the output signal P-DET of the OR circuit 20. Numeral 21 denotes a multiplexer which switches input voltages X-OUT and Y-OUT from the peak hold circuits at high speed to supply the switched voltages to an A/D converter 22 which measures the voltages from the multiplexer as digital data successively.

Numeral 23 denotes a microcomputer and numeral 24 denotes an input/output interface (hereinafter referred to as I/O) for the microcomputer 23. The I/O produces the SAMP signal to the multiplexer 21 in response to the P-DET command to receive the A/D converted data.

Numeral 25 denotes a rectifier which converts the output voltage of the oscillator 1 which is supplied to the bridge circuit to a dc voltage.

The rectifier 25 watches drift in the voltage supplied to the bridge circuit and an output of the rectifier 25 is supplied through the multiplexer 21 to the A/D converter 22 by the time division switching at the sampling time of the variation voltages X-OUT and Y-OUT by the coin.

With the foregoing configuration according to the present invention, even if the bridge circuit including the detection coil drifts due to variation in the temperature when the coin does not pass and produces an erroneous voltage, the voltage varies slowly and accordingly the outputs of the automatic balancing circuits 14 and 15 are always controlled to be zero automatically so that the voltage variation is not added to the output voltages X and Y upon passage of the coin and accordingly erroneous decision can be prevented.

Figure 3:
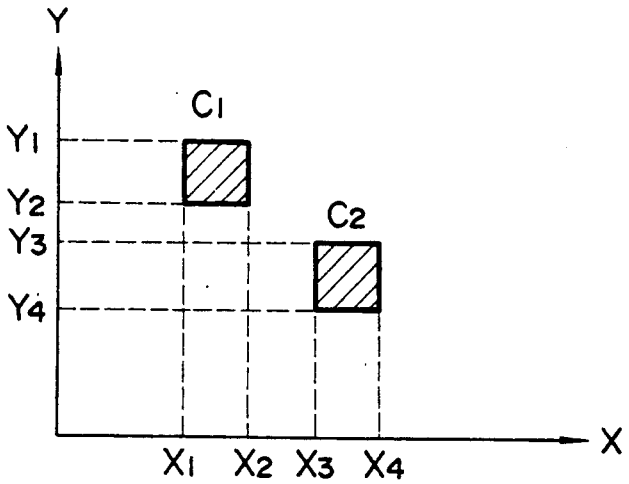
FIG. 3 is a discrimination logic diagram.

The logic or operation of discriminating the coin is shown in FIG. 3. Judgment levels for each coin are stored in a memory of the microcomputer 23. For example, real components $X_1$–$X_2$ and imaginary components $Y_1$–$Y_2$ are stored as the judgment level for a coin $C_1$ and in the same manner real components $X_3$–$X_4$ and imaginary components $Y_3$–$Y_4$ are stored as the judgment level for coin $C_2$. Thus, the output voltage upon passage of the coin is compared with the judgment levels so that judgment signal $C_1$, $C_2$, . . . $C_n$ are produced from I/O terminals.

Coins which do not satisfy the judgment levels can be discharged as a counterfeit coin.

As described above, according to the present invention, since the drift of the bridge circuit including the detection coil is always controlled to zero by the automatic balancing circuit automatically, the output by the coin does not contain error and accordingly judgment for the coin is attained without error even if the drift occurs.

Further, even if the voltage supplied to the bridge circuit drifts, since this voltage variation is measured each time the coin is detected and the output voltage for the coin is corrected, exact judgment can be made without influence of variation in the voltage supplied to the bridge circuit.

Accordingly, the conventional circuit has a problem that judgment accuracy is deteriorated due to variation of the temperature, although in the present invention even if the temperature is varied, stable judgment accuracy can be maintained.

On the other hand, when the voltage supplied to the bridge circuit drifts due to the temperature, the output voltages X and Y by the coin are varied to X' and Y' in proportion to the variation of the voltage supplied to the bridge circuit, while since the voltage supplied to the bridge circuit is measured every detection of the coin, a ratio of the measured value V' and an initial value V stored previously in the memory, that is, V'/V is calculated and the outputs X' and Y' for the coin are corrected on the basis of the ratio so that exact outputs X and Y for the coin can be always obtained even if the voltage supplied to the bridge circuit. Operation described above can be processed easily by the microcomputer.

We claim:

1. A coin discriminator including a bridge circuit having a detection coil, a reference coil and a balancing circuit, an oscillator for supplying a high frequency voltage to the bridge circuit, a tuned amplifier for amplifying an output voltage of the bridge circuit, a phase shifter for producing an in-phase voltage and a voltage delayed by $\pi/2$ in respect to an oscillation voltage of the oscillator and a phase detector for detecting an in-phase component and a $\pi/2$ delayed component from an output voltage of the tuned amplifier on the basis of the in-phase voltage and the $\pi/2$ delayed voltage produced by the phase shifter to thereby discriminate a coin on the basis of a voltage variation in the in-phase component and the $\pi/2$ delayed component, comprising first and second automatic balancing circuits each including a differential amplifier and an integrator, the differential amplifiers for the first and second automatic balancing circuits having one input terminals to which output voltages of the in-phase component and the $\pi/2$ delayed component are supplied, respectively, and the other input terminals to which an output voltage of the integrator is supplied, an output signal of the differential amplifier being supplied to the integrator, a circuit for automatic compensating slow variation when an output of the detection coil is drifted due to a temperature, and a rectifier for converting the voltage of the oscillator supplied to the bridge circuit to a dc voltage, whereby variation voltages in the in-phase voltage component and the $\pi/2$ delayed voltage component produced from the bridge circuit through the automatic balancing circuit and a rectified output voltage supplied to the bridge circuit are calculated to discriminate a kind of the coin and a counterfeit coin.

2. A coin discriminator according to claim 1, comprising a peak hold circuit for holding peak values of the in-phase component and $\pi/2$ delayed component voltages of the bridge circuit obtained through the automatic balancing circuit and a peak detection circuit for detecting passage of peak points of both output voltages, whereby variations by the coin of the in-phase component and $\pi/2$ delayed component voltage produced by the bridge circuit are obtained on the basis of the in-phase component and $\pi/2$ delayed component peak values and the output voltage obtained by rectifying the voltage supplied to the bridge circuit to thereby discriminate whether the coin is genuine or counterfeit and decide an amount of coin.

3. A coin discriminator according to claim 2, comprising a time division switching circuit supplied with the peak values of the outputs of the two automatic balancing circuits for the in-phase component and the $\pi/2$ delayed component and the output voltage of the rectifier, an A/D converter for converting an output voltage of the time division switching circuit to a digital voltage successively, and a microcomputer triggered by an OR signal of the peak detection circuits to take in the digital voltage from the A/D converter, whereby the microcomputer discriminates whether the coin is genuine or counterfeit and decide an amount of the coin.

4. A coin discriminator including a bridge circuit having a detection coil, a reference coil and a balancing circuit, an oscillator for supplying a high frequency voltage to the bridge circuit, a tuned amplifier for amplifying an output voltage of the bridge circuit, a phase shifter for producing an in-phase voltage and a voltage delayed by $\pi/2$ in respect to an oscillation voltage of the oscillator and a phase detector for detecting an in-phase component and a $\pi/2$ delayed component from an output voltage of the tuned amplifier on the basis of the in-phase voltage and the $\pi/2$ delayed voltage produced by the phase shifter to thereby discriminate a coin on the basis of a voltage variation in the in-phase component and the $\pi/2$ delayed component, comprising a circuit for automatically compensating slow variation produced when the detection coil drifts due to temperature by an automatic balancing circuit including a differential amplifier and an integrator from the in-phase component and the $\pi/2$ delayed component output voltages of low pass filters, a circuit for holding a peak value of a voltage which is instantaneously changed when the coin passes through the detection coil, a peak detection circuit for detecting passage of the peak point, a rectifier for converting the voltage of the oscillator supplied to the bridge circuit to a dc voltage, a time division switching circuit for switching two outputs of the in-phase component and $\pi/2$ delayed component from the automatic balancing circuit and the voltage from the rectifier in time division manner, an A/D converter for converting an output voltage of the time division switching circuit to a digital voltage successively, and a microcomputer which receives a digital voltage from the A/D converter in response to an OR signal from the peak detection circuit and performs calculation and control, whereby variation voltages by the coin of the in-phase component and $\pi/2$ delayed component voltages produced from the bridge circuit and the output voltage obtained by rectifying the voltage supplied to the bridge circuit are calculated to discriminate a kind of the coin and a counterfeit coin.

* * * * *